United States Patent [19]

Hamilton et al.

[11] Patent Number: 4,795,551

[45] Date of Patent: Jan. 3, 1989

[54] SOLVENT REFINING OF RESIDUES

[75] Inventors: Gary L. Hamilton, Little Silver; Andrei Rhoe, Wyckoff; Donald P. Satchell, Princeton Junction, all of N.J.

[73] Assignee: Lummus Crest, Inc., Bloomfield, N.J.

[21] Appl. No.: 754,776

[22] Filed: Jul. 15, 1985

[51] Int. Cl.[4] ..... C10C 3/00

[52] U.S. Cl. ..... 208/309; 208/45; 208/188; 208/317; 208/320; 208/321; 196/14.52

[58] Field of Search ..... 208/309, 45, 188, 317, 208/320, 321; 196/14.52

[56] References Cited

U.S. PATENT DOCUMENTS

| | | | |
|---|---|---|---|
| 2,045,742 | 6/1936 | Winning et al. | 208/309 |
| 3,150,934 | 9/1964 | Hazard | 208/309 |
| 3,228,870 | 1/1966 | Pitchford | 208/309 |
| 3,334,043 | 8/1967 | Ferris et al. | 208/309 |
| 3,412,016 | 11/1968 | Garauen | 208/354 |
| 3,585,124 | 6/1971 | Myers | 208/354 |
| 3,627,675 | 12/1971 | Ditman et al. | 208/309 |
| 3,798,157 | 3/1974 | Manzanella et al. | 208/309 |
| 3,998,726 | 12/1976 | Bunas et al. | 208/309 |
| 4,017,383 | 4/1977 | Beavon | 208/309 |
| 4,273,644 | 6/1981 | Harris et al. | 208/321 |
| 4,315,815 | 2/1982 | Gearhart | 208/304 |
| 4,395,330 | 7/1983 | Auboir et al. | 208/309 |
| 4,502,944 | 3/1985 | Nelson | 208/309 |

*Primary Examiner*—H. M. S. Sneed
*Assistant Examiner*—Helane Myers
*Attorney, Agent, or Firm*—Elliot M. Olstein; Raymond J. Lillie

[57] ABSTRACT

In the solvent refining of a residual oil, a mixture of refined oil and refining solvent, and a mixture of pitch impurities and refining solvent are introduced into separate zones of a combination tower operated at a pressure of no greater than 100 psig to recover refining solvent from each of the mixtures. The combination tower is preferably A modified crude distillation tower from a preexisting crude unit, whereby idle crude units may be converted to solvent refining.

19 Claims, 5 Drawing Sheets

SOLVENT REFINING OF RESIDUES

This invention relates to the solvent refining of heavy fractions containing pitch like empanties, sometimes referred to as residues (residual oils), and more particularly to the removal of pitch-like impurities from residues, sometimes referred to as deasphalting. This invention further relates to the conversion of existing equipment employed for purposes other than solvent refining of residues to a unit for the solvent refining of residues.

Solvent refining of residues so as to separate a refined oil from a pitch impurity is a technique generally known in the art. Thus, for example, deasphalting of residues by use of a deasphalting solvent so as to separately recover pitch and deasphalted oil is a technique generally known in the art. In general, such deasphalting involves contacting the residue with a deasphalting solvent at an elevated pressure to produce a first fraction comprised of deasphalted oil and deasphalting solvent, and a second fraction comprised of pitch and deasphalting solvent.

The first fraction comprised of deasphalted oil and deasphalting solvent is introduced into a first tower operated at an elevated pressure to recover deasphalting solvent for reuse in the process. The fraction comprised of deasphalting solvent and pitch is introduced into a second tower operated at an elevated pressure to recover solvent for reuse in the process. The elevated pressures for deasphalting and solvent recovery are generally in the order of from 300 to 600 PSIG.

The present invention is directed to providing a process for solvent refining of residues and in particular a process which can be adopted to processing equipment originally installed for procedures other than solvent refining.

In accordance with one aspect of the present invention, there is provided an improved process for solvent refining of residue.

In accordance with a further aspect of the present invention, there is provided a process for solvent refining of residue which may be accomplished in a crude unit which has been converted for use in the solvent refining of residue wherein any equipment which existed in the crude unit and which is used in the process is operated at a pressure no greater than its design pressure.

Applicant has found that it is possible to provide a solvent refining process which is operated at lower pressures, and in which solvent is recovered from both the solvent refined oil fraction and the pitch-like residue at lower pressures in a single tower (a combination tower). Applicant has further found that it is possible to convert crude units or similar distillation units to units for solvent refining of residue by converting the crude or similar distillation tower, which is designed for operation at lower pressures, to a low pressure combination tower for recovering solvent from both the solvent refined oil and the pitch fractions at a pressure no greater than the design pressure for the tower. In general, such towers are designed to operate at a pressure no greater than 100 PSIG.

More particularly, in accordance with one aspect of the present invention, there is provided a process for solvent refining of a residue wherein the residue is contacted with a refining solvent in a solvent refining zone so as to recover from the solvent refining zone a first mixture comprised of solvent refined oil and solvent, and a second mixture comprised of pitch and solvent. The first mixture is introduced into a first zone of a combination tower to separate solvent from solvent refined oil, and the second mixture is introduced into a second zone of the combination tower to separate solvent from the pitch with the combination tower being operated at a pressure which is no greater than 100 PSIG and which does not exceed the design pressure for the tower. The solvent recovered from both the solvent refined oil and the pitch fractions is reused in the solvent refining process.

The above procedure has particular applicability to deasphalting of oil by use of a deasphalting solvent, as is hereinafter described in more detail.

In accordance with a further aspect of the present invention, a crude unit is modified for use as a unit for the solvent refining of residue. More particularly, the crude distillation tower of a crude unit is divided into at least first and second separation zones, with the first zone being converted to receive a mixture of solvent refined oil and refining solvent, and the second zone being converted to receive a mixture of refining solvent and pitch, with refining solvent being separated in each of the zones. In this manner, idle crude distillation units may be converted to units for upgrading of various residue feedstocks by a solvent refining process wherein any pre-existing equipment used in the solvent refining is not operated at a pressure greater than its design pressure.

The invention will be further described with reference to the following drawings, wherein.

It is to be understood, however, that the scope of the present invention is not to be limited to the embodiments of the drawings.

The present invention will be described with respect to the preferred embodiments with particular relationship to a process for deasphalting of residues by use of a deasphalting solvent; however, it is to be understood that the scope of the invention is not limited to such a deasphalting process.

Figure 1:
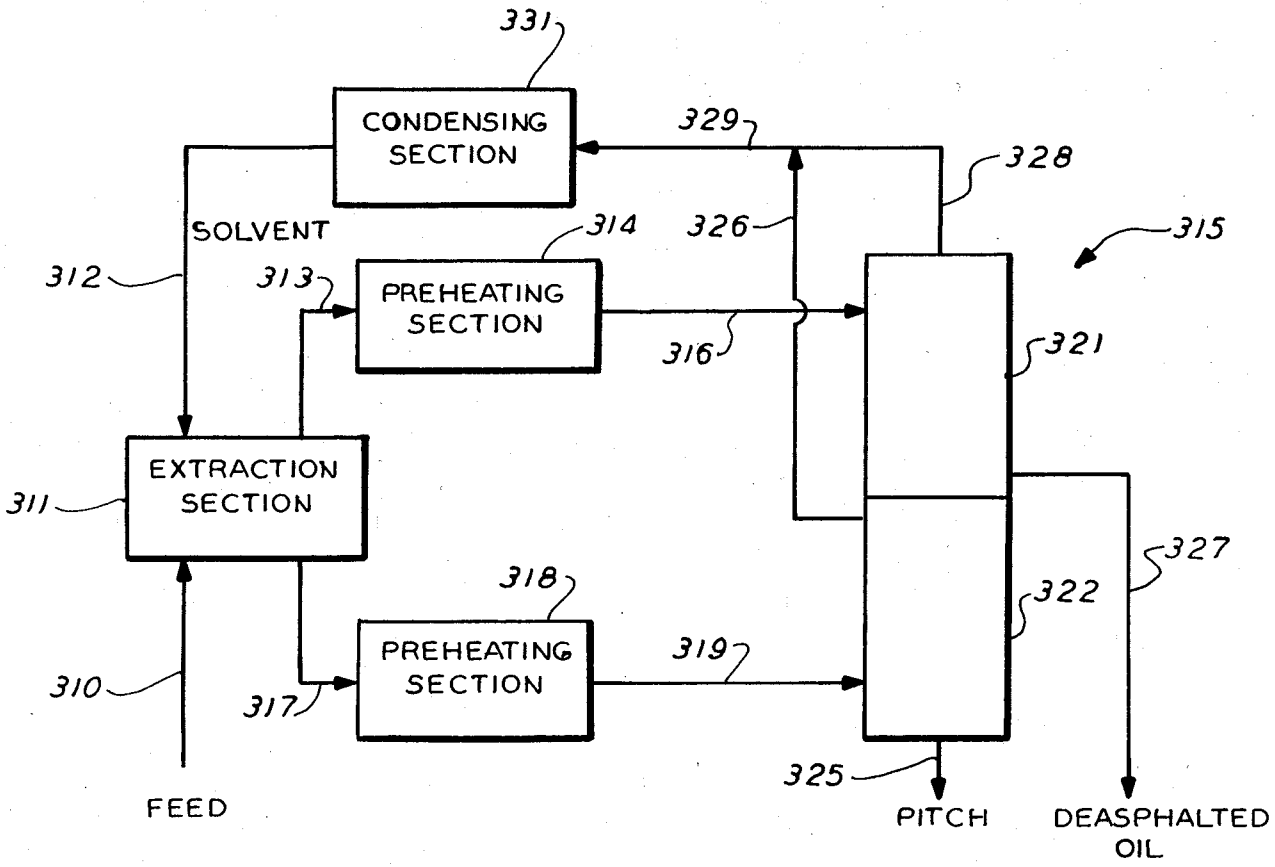
FIG. 1 is a simplified schematic block diagram of a procedure for accomplishing solvent refining of a residue.

Referring now to FIG. 1 of the drawings, a residue which is to be subjected to solvent refining; in particular, deasphalting, such as a black oil, in line 310 is introduced into a separation zone, schematically generally indicated as 311, along with a deasphalting solvent in line 312.

The deasphalting solvent may be any one of a wide variety of deasphalting solvents as hereinafter described, and although the deasphalting solvent is shown as being introduced into the separating zone 311 independently of the feed in line 310, it is to be understood that the solvent may be pre-mixed with the feed. It is also to be understood that the solvent may be comprised of a single material, or more than one material, and that if the solvent is comprised of more than one material the materials may be separately mixed with the feed.

The separating zone 311 functions to remove a pitch-like impurity from the feed and provide a heavy fraction comprised of deasphalting solvent and pitch, and a lighter fraction comprised of deasphalted oil and deasphalting solvent.

The separating zone 311 may include a single stage settler, and in accordance with a preferred embodiment, the separator 311 is a desalter of a pre-existing crude unit, which has been converted to a single stage settler. Alternatively, the separator 311 may be an existing desalter or desalters or new equipment which has been suitably converted to permit stage wise contacting of the residue and solvent. As a further alternative, the residue feed and deasphalting solvent may be contacted in a vertical multi-stage countercurrent contactor, such as a baffle type extractor or a rotating disc contactor.

The separating zone 311 is operated at conditions as hereinafter described.

A lighter fraction comprised of deasphalting solvent and deasphalted oil is withdrawn from separator 311 through line 313 and preheated in a preheating section, schematically generally indicated as 314, prior to being introduced into a combination tower, schematically generally indicated as 315, through line 316.

Similarly, the heavy fraction, comprised of a pitch-like residue and deasphalting solvent, is withdrawn from separation zone 311 through line 317, and such heavy fraction is heated in a preheating zone 318 prior to being introduced into the combination tower 315 through line 319.

The preheating sections 314 and 318 may be formed from any one of a wide variety of heat exchangers so as to obtain maximum heat recovery; however, in accordance with a preferred embodiment, the heat exchangers present in a crude unit are employed in a manner so as to accomplish preheating of the light and heavy fraction, as well as to maximize heat recovery. For example, it may be possible to employ an existing preflash drum of the crude unit and/or existing fired heaters, and if only one heater exists, it may be possible to modify such heater so as to employ the heater for preheating both the heavy and light fraction. Alternatively, new heat exchange equipment may be added.

The combination tower 315 is divided into a first zone or section 321 for separating deasphalted oil from deasphalting solvent, and a second zone or section 322 for separating deasphalting solvent from a pitch-like residue.

The combination tower 315 may be a new piece of equipment or in accordance with a preferred embodiment, the combination tower 315 is a modification of the crude distillation tower employed in a crude unit. Thus, for example, section 321 may be formed by modification of a portion of the existing tower internals to accommodate either a single, double or triple effect flash recovery system, with the resulting vapors being removed from the tower for solvent condensing and stripping gas recycle. Alternatively, the existing tower internals can be modified to accomodate a single flash stage in conjunction with a solvent condensing zone (internally accomplished by conventional pump around heat removal techniques). In addition, one or more of the existing side stripping towers can be suitably modified for the removal of residual solvent from deasphalted oil by use of a stripping gas.

The second section or zone 322 for separating deasphalting solvent from pitch may be formed by modifying existing tower internals so as to accomodate a single flash stage with the resulting vapors being removed from the tower for solvent condensing and stripping gas recycle. Alternatively, existing tower internals can be modified to provide a single flash stage, with the resulting vapors being introduced into the solvent condensing zone of the first zone or stage 321. In both such embodiments, it is preferred to employ a stripping gas for removal of residual solvent from the pitch.

As a further alternative, a new flash drum can be added in parallel with the second zone or section 322 so as to provide additional pitch-solvent separation capacity up to the limit of other existing equipment.

As should be apparent, however, it is possible to provide a new combination tower, rather than using preexisting equipment.

A pitch is withdrawn from the lower section 322 through line 325, and the solvent which is separated from the pitch is withdrawn from section 322 through line 326.

Deasphalted oil, which is essentially free of deasphalting solvent, is withdrawn from section 321 through line 327, and deasphalting solvent is withdrawn from section 321 through line 328.

The separated deasphalting solvent in lines 326 and 328 are combined in line 329 for introduction into a solvent condensing zone, schematically generally indicated as 321. The solvent condensing zone or section 331 which is employed will be dependent upon the materials which are used in formulating the deasphalting solvent. It is possible to employ equipment existing in a crude unit for effecting such solvent condensation, or in the alternative, a new condensing section may be employed. Although it is possible to effect condensing at elevated pressures, in accordance with the preferred embodiment, condensing is accomplished at pressures no greater than those which exist in the combination tower; i.e., a pressure no greater than about 100 PSIG, typically 30 to 100 PSIG.

Thus, in accordance with the preferred embodiments, the solvent is selected so that the solvent may be condensed without employing external compression.

The external condensing can be accomplished by heat exchange against process, air, and/or water. As hereinabove indicated, it is also possible to employ some internal condensing by use of external pump around (circulating solvent reflux) and heat exchange against process, air, and/or water.

Condensed solvent is withdrawn from the solvent condensing section 331 through line 312 for use in deasphalting, as hereinabove described.

As should be apparent, the description of the invention with respect to FIG. 1 provides a general description of solvent refining of a residue in accordance with the present invention. Preferred embodiments of the invention, and in particular with respect to the use of equipment which exists in a crude distillation unit will be described with respect to FIGS. 2, 3 and 4 of the drawings.

Figure 2:
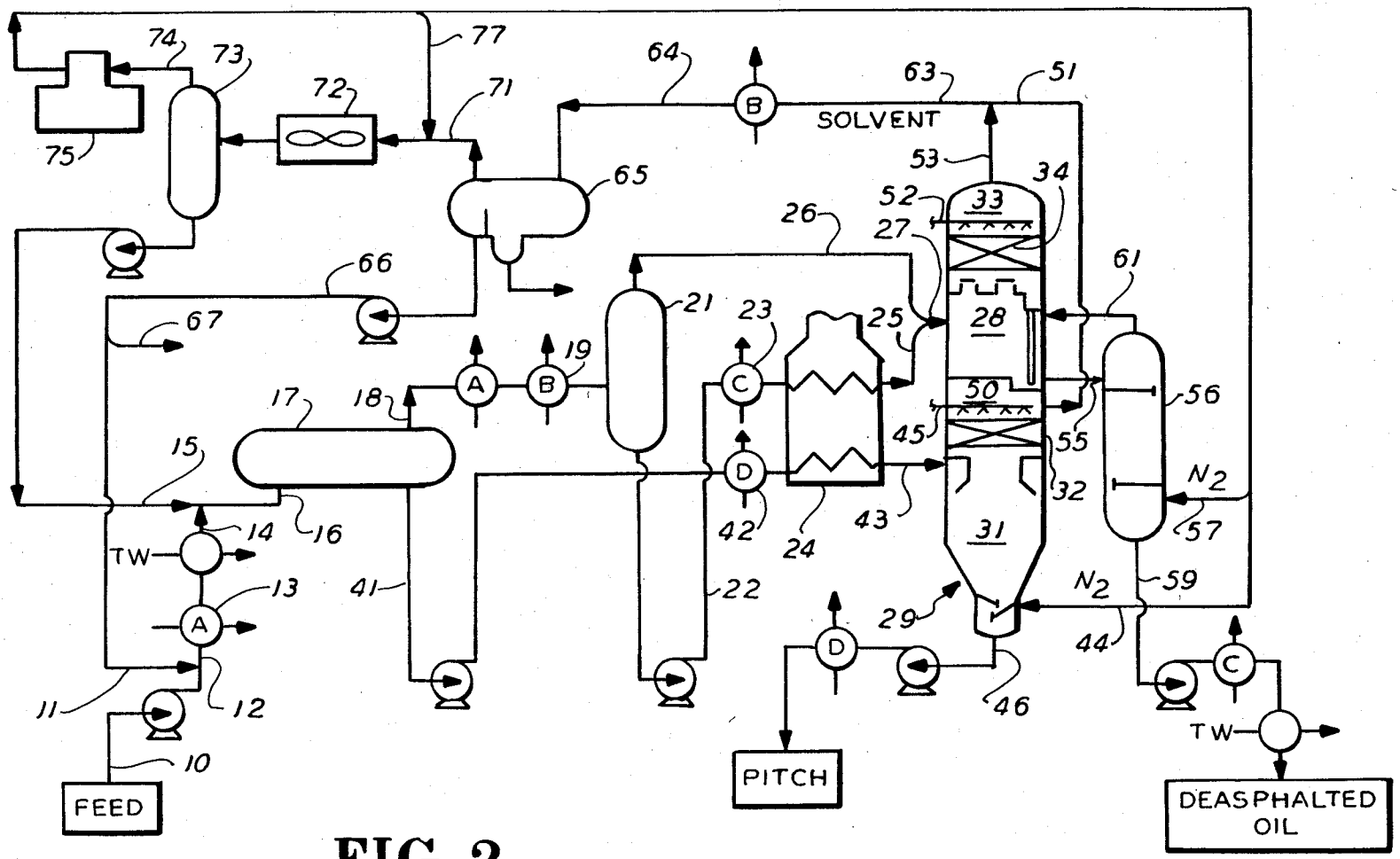
FIG. 2 is a simplified schematic representation of an embodiment for accomplishing solvent refining of a residue in a converted crude unit.

Referring now to FIG. 2 of the drawings, there is shown a process in accordance with the present invention wherein the deasphalting solvent is comprised of two different components which are separately added to the residue to be deasphalted. In particular, the deasphalting solvent which is employed is a combination of toluene and methanol; however, the scope of the invention is not limited to such components.

A residue which is to be subjected to solvent refining; in particular, deasphalting, such as a black oil, in line 10 is mixed with the diluent component of the deasphalting solvent, which is provided through line 11. As particularly described, the material in line 11 is toluene.

The oil and toluene in line 12 is passed through a heat exchanger train, which is schematically designated as heat exchanger train A, and the cooled mixture in line 14 is mixed with the precipitant component of the deasphalting solvent in line 15; in particular, methanol. The toluene is added prior to the methanol in order to dilute the feed and dissolve asphaltene components which are to be precipitated. The subsequent addition of methanol precipitates asphaltenes which are dissolved in the solvent mixture. By varying the relative proportions of the diluent component (toluene) and precipitant component (methanol), the extent of solution and precipitation can be controlled.

A combined stream in line 16 is introduced into a horizontal separating tank 17, which was previously the desalter of the crude unit. In separator 17, the mixture is separated into a heavy fraction comprised of deasphalting solvent and pitch, and a lighter fraction comprised of the deasphalted oil and deasphalting solvent. The separator 17 is generally operated at a temperature in the order of from 120° F. to 300° F., and a pressure no greater than the design pressure for the converted desalter. Such design pressures are generally in the order of from 150 to 250 PSIG. Depending on the solvent employed, operating pressures are generally in the order of from 50 to 250 PSIG. It is to be understood that the scope of the invention is not limited to use of the pre-existing desalter.

A mixture of deasphalted oil and deasphalting solvent is withdrawn from separating tank 17 through line 18 and heated in the heat exchange train A by indirect heat transfer with the mixture in line 12 and in heat exchanger train B, generally designated as 19, with the heated mixture then being introduced into a flash drum 21, which was previously the crude preflash drum of the preexisting crude unit.

Unflashed material is withdrawn from drum 21 through line 22 and heated in heat exchanger train C, schematically generally indicated as 23, and then further heated in heater 24, which was previously the crude heater of the pre-existing crude unit.

The flashed material from drum 21 recovered through line 26 is combined with the heated material in line 25, and the combined stream in line 27 is introduced into section 28 of a combination tower, generally indicated as 29, which combination tower was previously the crude distillation tower of the preexisting crude unit. As particularly shown, the combination tower 29 includes a first zone for separating solvent from deasphalted oil comprised of sections 33 and 28, and a second zone for separating solvent from pitch comprised of sections 31 and 50. Sections 33 and 50 are provided with suitable packing, or other suitable heat/mass transfer devices, designated as 34 and 32, respectively.

Referring back to the separator 17, a mixture of pitch and deasphalting solvent is withdrawn from separator 17 through line 41, and is heated in heat exchanger train D, schematically generally indicated as 42, and in heater 24 prior to being introduced through line 43 into the lower section 31 of the combination tower 29. As particularly shown the material from heat exchanger trains C and D, respectively, are heated in separate coils in heater 24.

In section 31, solvent is stripped from the pitch and section 31 is provided with a stripping gas, such as nitrogen, through line 44. In section 50, there is provided washing and desuperheating of stripped solvent by introduction of a solvent wash, above packing 32 through line 45. Thus, the second zone comprised of sections 31 and 50 functions as a flash-drum stripper, a desuperheater and a wash facility.

The combination tower 29 is operated at a pressure no greater than the design pressure for the distillation tower of the pre-existing crude unit; i.e, a pressure no greater than 100 PSIG.

Pitch, essentially free of solvent, is withdrawn from the lower section 31 through line 46, with the pitch being cooled in heat exchanger train D by indirect heat transfer with the material in line 41, with the pitch then being passed to a suitable pitch accumulating zone (not shown) for disposal or suitable use.

Vaporized deasphalting solvent is withdrawn from the upper portion of section 50 through line 51.

In the first zone of combination tower 29 comprised of sections 28 and 33, deasphalting solvent is recovered from deasphalted oil, with the sections 28 and 33 functioning as a flash drum and additionally providing solvent desuperheating and wash. Washing is accomplished by introduction of a solvent wash through line 52 above packing 34.

Vaporized deasphalting solvent is withdrawn from the upper portion of section 33, through line 53.

Deasphalted oil, still containing some solvent is withdrawn from section 28 of combination tower 29 through line 55 for introduction into a sidestream stripper, schematically generally indicated as 56, which can be one or more of the sidestream strippers which was previously employed for the crude distillation tower. The sidestream stripper 56 is provided with stripping gas, such as nitrogen, through line 57.

Deasphalted oil, essentially free of deasphalting solvent, is withdrawn from sidestream stripper 56 through line 59 with the deasphalted oil being cooled in heat exchanger train C, prior to being passed to a suitable storage zone and/or further use.

Deasphalting solvent is recovered from sidestream stripper 56 through line 61 for return to the section 28 of the combination tower 29.

Deasphalting solvent in line 53, and deasphalting solvent in line 51 are combined in line 63, with the combined stream being cooled in heat exchanger train B to a temperature at which the toluene solvent is condensed from the mixture.

The cooled stream in line 64 is introduced into a separator 65, which was previously the crude tower overhead accumulator, for separation of condensed solvent rich in toluene, which is recovered through line 66. The major portion of the condensed solvent in line 66 is employed in line 11, as hereinabove described, with a further portion being passed through line 67 for subsequent use as a solvent wash in lines 45 and 52.

The uncondensed portion, recovered from separator 65, in line 71, is primarily comprised of the nitrogen stripping gas and methanol. Such uncondensed portion is then further cooled in an air cooler 72 to a temperature at which additional solvent rich in methanol is condensed from the gas, with the gas-liquid mixture from air cooler 72 being introduced into a suitable separator, schematically indicated as 73. Condensed solvent rich in methanol is withdrawn from separater 73 through line 15 for use as hereinabove described.

The condensation of vaporized solvent removed from combination tower 29 is accomplished at a low pressure; i.e., a pressure less than 100 PSIG.

Uncondensed gas withdrawn from separater 73 through line 74 is compressed in compressor 75 and recycled as stripping gas for use in the sidestream stripper 56 and the combination tower 29. A portion of the compressed gas from compressor 75, in line 77, is recycled to the air cooler 72 through line 77 for pressure control. The air cooler 72, compressor 75 and separater 73 may be the equipment which previously formed a portion of the crude overhead condensing and gas compression system.

Thus, by proceeding in accordance with the embodiment of FIG. 2, it is possible to employ equipment which exists in a crude unit for the solvent refining of residue. Moreover, such a result can be achieved by employing the low pressure equipment which is present in such a crude distillation unit.

Figure 3:
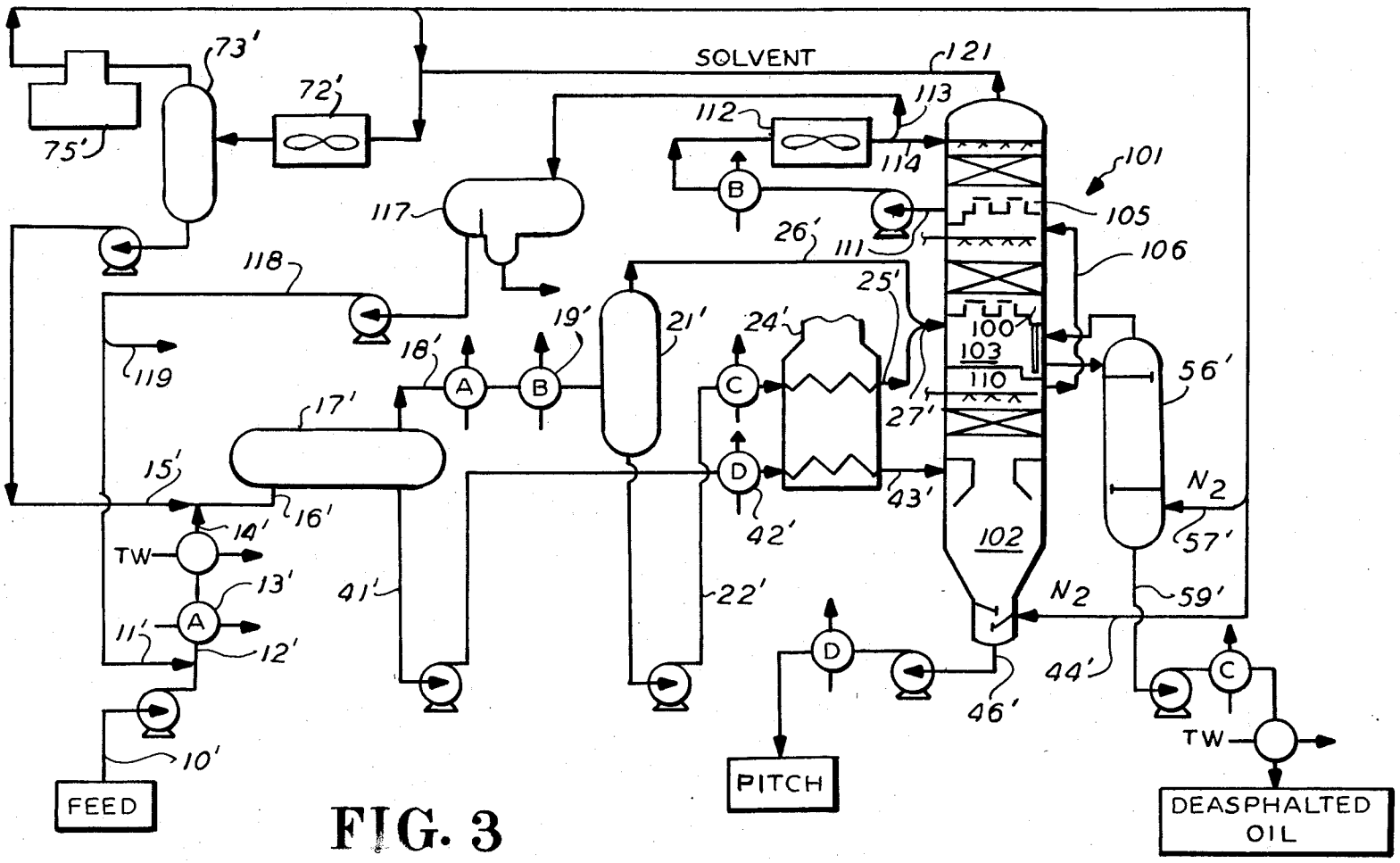
FIG. 3 is a simplified schematic representation of another embodiment for the solvent refining of a residue in a converted crude unit.

A further embodiment of the present invention is illustrated in FIG. 3 of the drawings. In accordance with the embodiment of FIG. 3, again two components are employed in formulating the deasphalting solvent; however, the component comprising the diluent solvent has a boiling point such that such component can be recovered by condensation in the combination tower. Thus, for example, in accordance with the embodiment of FIG. 3, the deasphalting solvent is comprised of a combination of methanol and naphtha. Although the embodiment is specifically described with respect to the use of naphtha, it is to be understood that other components may also be employed within the spirit and scope of the present invention. In the embodiment of FIG. 3, those portions of the embodiment which are similar to the embodiment of FIG. 2 of the drawings are represented by like prime numerals.

Referring now to FIG. 3 of the drawings, deasphalting of the residue in deasphalting separation zone 17$^1$, the use of a flash drum 21$^1$, and a heater 24$^1$ are similar to the use of such equipment in the embodiment of FIG. 2 of the drawings. The exception being that the solvent component employed in line 11$^1$ is naphtha instead of toluene.

The mixture of deasphalted oil and deasphalting solvent in line 27$^1$ is introduced into a combination tower 101, which was previously the crude distillation tower of a crude unit. The tower is modified so as to provide a second zone comprised of sections 102 and 110 for separating deasphalting solvent from pitch, and a first zone comprised of sections 103, 104 and 105 for separating deasphalting solvent from the deasphalted oil, as well as for separating the naphtha portion of the deasphalting solvent from the methanol portion.

Sections 102 and 110 of tower 101 function in a manner similar to sections 31 and 50 of tower 29 of the embodiment of FIG. 2.

Deasphalting solvent which is separated from the pitch in the second zone is introduced into the upper portion of section 104 through line 106 for the purpose of separating naphtha from methanol in section 105.

Sections 103 and 104 function in a manner similar to sections 28 and 33 of tower 29 of the embodiment of FIG. 2.

The top section 105 is operated as a condensing section so as to condense naphtha from the separated deasphalting solvent. The upper section 105 is provided with a side stream line 111 for withdrawing from section 105 a circulating stream of naphtha reflux, as well as naphtha for use in the deasphalting solvent. The naphtha in line 111 is cooled in heat exchanger train B, and further cooled in an air cooler 112 to provide a cool reflux for the upper portion of section 105. Net naphtha recovered in combination tower 101 is withdrawn through line 113, with the remaining portion, in line 114, being introduced into the top portion of section 105 as reflux for condensing naphtha from the separated deasphalting solvent.

Naphtha in line 113 is introduced into a surge vessel 117, which was previously the crude tower overhead accumulator, with the recovered naphtha being withdrawn from surge tank 117 through line 118 for use as a solvent wash in line 119, and to provide a naphtha rich diluent solvent for use in the deasphalting through line 11.

The methanol portion of the deasphalting solvent is withdrawn as vapor from combination tower 101 through line 121 for separating of methanol from nitrogen stripping gas by use of an air cooler 72$^1$, a separating tank 73$^1$ and compressor 75$^1$, as hereinabove described with reference to the embodiment of FIG. 2.

Thus, in accordance with the embodiment of FIG. 3, there is provided a procedure for deasphalting of residue which employs equipment which was existing in a crude distillation unit, and which provides for effective recovery of deasphalting solvent, at low pressures so as to provide a two component deasphalting solvent mixture, whereby pre-existing equipment can be used at a pressure no greater than its design pressure.

Figure 4:
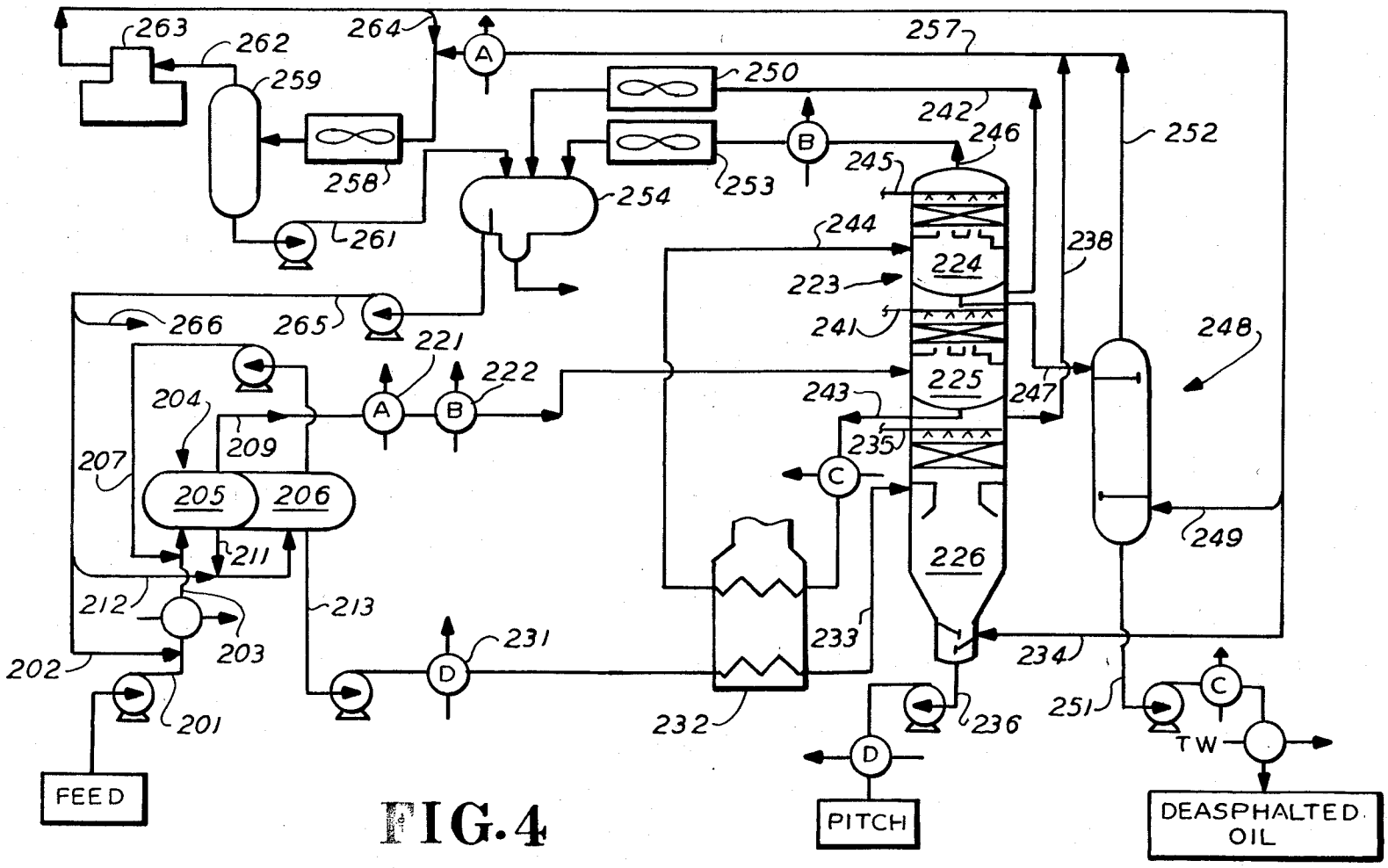
FIG. 4 is a simplified schematic representation of still another embodiment of the present invention for solvent refining of a residue in a converted crude unit.

Still another embodiment of the present invention is shown in FIG. 4 of the drawings. In the embodiment of FIG. 4, the deasphalting solvent is comprised of components which have similar boiling points which need not be independently added to the oil. The embodiment of FIG. 4 incorporates further improvements in a solvent refining process.

Referring now to FIG. 4 of the drawings, a residue to be subject to solvent refining; in particular deasphalting, in line 201, is combined with deasphalting solvent in line 202, which as particularly described is comprised of isopropanol and methanol.

The combined stream in line 203 is introduced into a separater, schematically generally indicated as 204, which separater 204 was previously the desalter of the pre-existing crude unit. As particularly shown, the separater 204 is divided into two separate compartments 205 and 206.

The mixture in line 203 is combined with a recycled portion from section 206 of separater 204, which is in line 207, and is obtained as hereinafter described.

The deasphalting separater 204 is generally operated at a temperature of from 200° F. to 300° F., and at a pressure no greater than the design pressure of the converted desalter; i.e., generally the design pressure is from 150 to 250 PSIG. Deasphalted oil and deasphalting solvent is withdrawn from secton 205 through line 209.

A mixture of deasphalting solvent and the heavier component of the feed; in particular, the asphaltene and resin components, are withdrawn from section 205 through line 211, and the mixture is combined with additional deasphalting solvent in line 212, prior to being introduced into section 206 of the separater 204. In section 206, the heavier portion comprised of resins and asphaltenes and deasphalting solvent is separated from a lighter portion comprised of resin containing some of the deasphalted oil and deasphalting solvent.

The pitch comprised of resins and asphaltenes in combination with deasphalting solvent is withdrawn from section 206 through line 213, and the lighter portion, comprised of resin and some deasphalted oil in deasphalting solvent is withdrawn from section 206 through line 207 for recycle to section 205.

The deasphalted oil and deasphalting solvent in line 209 is passed through heat exchanger train A, generally designated as 221 and heat exchanger train B, generally designated as 222 for introduction into an intermediate section of a combined tower, generally designated as 223, which combined tower was previously the crude distillation tower of the crude unit, which has been modified so as to accomplish effective recovery of deasphalting solvent. As particularly shown, the combination tower 223 is divided into three sections 224, 225 and 226, with each of the sections being designed to operate at different pressures. In particular, section 224 is operated at a pressure which is higher than the pressure in section 225, and the pressure in section 225 is higher than the pressure in section 226. The pressure in the combination tower 223 does not exceed the design pressure for the tower; i.e., no greater than 100 PSIG.

In this way the combination tower 223 is capable of being operated as a multiple effect evaporater. Each of the separate sections 224, 225 and 226 is provided with sub-sections, one of which sub-section is used for flashing of solvent and the other of which is employed for washing and desuperheating, as described with reference to previous embodiments.

The mixture withdrawn from section 206 through line 213, which is comprised of pitch and deasphalting solvent, is passed through heat exchanger train B, schematically generally indicated as 231, and then through heater 232, which was previously the crude heater for the pre-existing crude distillation unit. The heated mixture in line 233 is introduced into the lower section 226 of the combination tower 223.

The lower section 226 is provided with a stripping gas, such as nitrogen through line 234, and with a solvent wash through line 235. The section 226 is designed and operated so as to separate the deasphalting solvent from the pitch. The pitch is withdrawn from section 226 through line 236 and is cooled in heat exchanger train B prior to being passed to a suitable accumulation zone (not shown) for disposal or suitable use.

Deasphalting solvent which has been separated from the pitch in section 226 of combination tower 223 is withdrawn through line 238.

The section 225 of the combination tower 223 is operated to provide for initial separation of deasphalting solvent from deasphalted oil, and is further provided with a solvent wash through line 241.

Deasphalting solvent which is separated in Section 225 is withdrawn therefrom through line 242.

Deasphalted oil, still containing some of the deasphalting solvent is withdrawn from section 225 through line 243, and is heated in heat exchanger train C, as well as in the heater 232, prior to being introduced into section 224 of the Combination Tower 223 through line 244. As hereinabove indicated, section 224 is operated at a pressure which is higher than the pressure prevailing in Section 225. The Section 224 is also provided with a solvent wash through line 245.

Deasphalting solvent which is separated in section 224 is withdrawn through line 246.

Deasphalted oil, still containing some deasphalting solvent, is withdrawn from section 224 through line 247 and introduced into a sidestream stripper, generally designated as 248, which was previously one or more of the sidestream strippers for the crude distillation unit. The sidestream stripper is provided with a stripping gas, such as nitrogen, through line 249.

The deasphalted oil is withdrawn from sidestream stripper 248 through line 251 and is cooled in heat exchanger train C, prior to being passed to storage and/or further use.

Deasphalting solvent is recovered from the sidestream stripper 248 through line 252.

The solvent vapor withdrawn from combination tower 223 through line 246 is cooled in heat exchanger train B, and further cooled in air cooler 253 so as to condense the solvent, with the condensed solvent being introduced into a tank 254, which was previously the crude tower overhead accumulator.

Solvent vapor in line 242 is cooled in air cooler 250 to condense solvent, with condensed solvent being introduced into tank 254.

Separated solvent and nitrogen in line 238 and that in line 252 are combined in line 257, and the combined stream is then cooled in heat exchanger train A, as well as air cooler 258 to condense solvent, with the gas liquid mixture being introduced into a separation tank 259.

Condensed solvent recovered through line 261 is introduced into the tank 254.

Solvent vapor which is recovered from pitch and deasphalted oil is condensed at a low pressure (less than 100 PSIG) for reuse in the process.

Uncondensed gas, in line 262, is compressed in compressor 263 for recycle to the sidestream stripper and combination tower as hereinabove described. A portion of the compressed gas is recycled to air cooler 258 through line 264 for pressure control.

Solvent is withdrawn from storage tank 254 through line 265, with a portion thereof being employed in line 266 for use as solvent wash in the combination tower 223, and the remaining portion being employed in lines 202 and 212 as hereinabove described.

Thus, in accordance with the embodiment of FIG. 4, there is provided a process for solvent refining of residue; in particular, de-asphalting, with a solvent in which the components thereof need not be separately added to the residue feed. Moreover, the process is operated in a manner such that there can be achieved a multiple effect evaporation of solvent to improve recovery of such solvent. Furthermore, such a result is achieved by use of equipment which is existing in a crude distillation unit.

RIDER A

Figure 5:
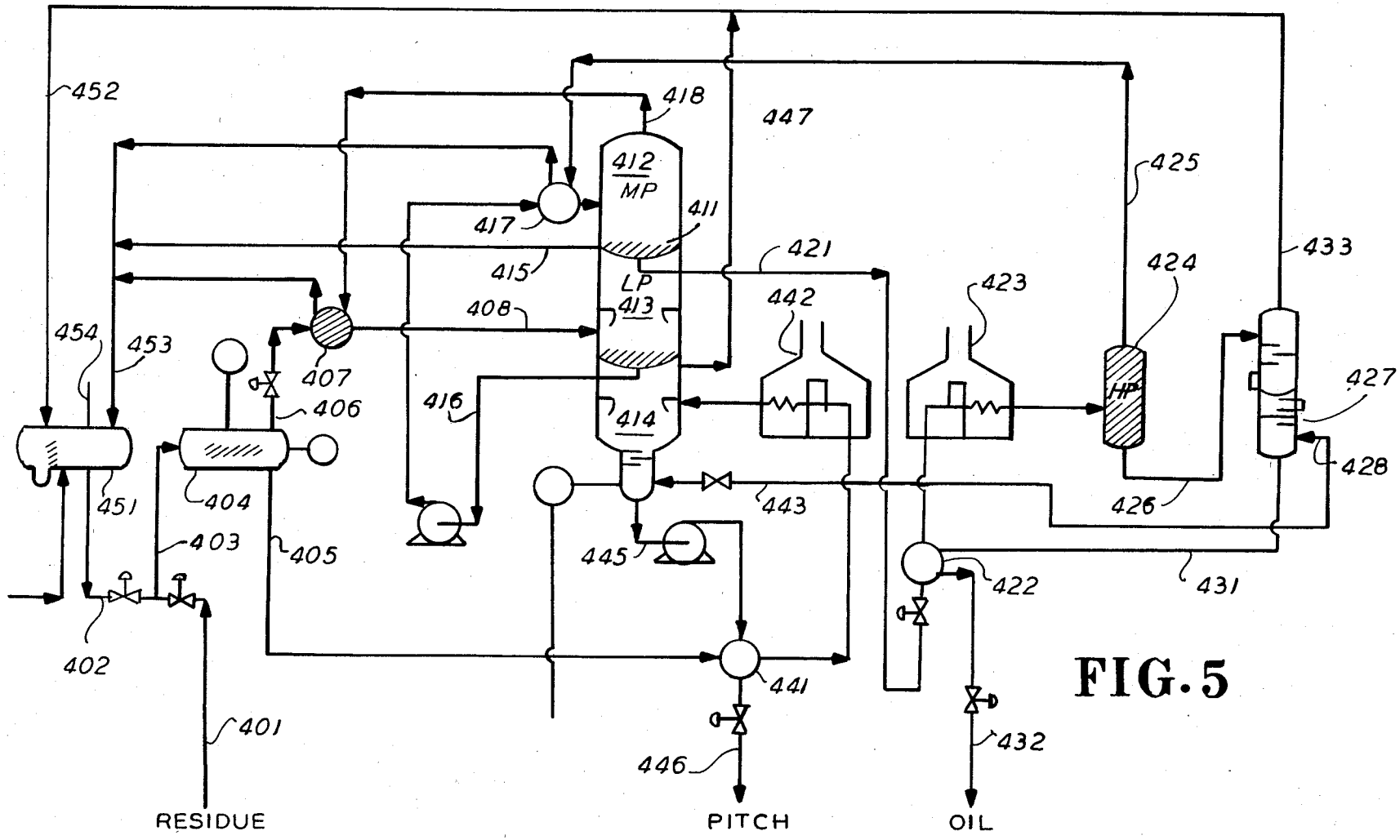

A further embodiment of the present invention is shown in FIG. 5 of the drawings. In the embodiment of FIG. 5, which is similar to the embodiment of FIG. 4, the deasphalting solvent is comprised of components which have similar boiling points which need not be independently added to the oil. In the embodiment of FIG. 5, the solvent is recovered by use of a multiple effect flash evaporation system.

Referring now to FIG. 5 of the drawings, a residue to be subjected to solvent refining; in particular deasphalting, in line 401, is combined with deasphalting solvent in line 402, which as particularly described is comprised of isopropanol and methanol. The combined stream in line 403 is introduced into a separator, schematically generally indicated as 404 for separating the residue into a lighter fraction, comprised of oil and deasphalting solvent, and a heavier fraction comprised of deasphalting solvent, as well as the asphaltene and resin components of the residue.

A pitch, comprised of resins and asphaltenes in combination with deasphalting solvent is withdrawn from separator 404 through line 405, and the lighter portion, comprised of deasphalted oil in deasphalting solvent is withdrawn from separator 404 through line 406.

The lighter portion in line 406 is passed through a heat exchanger 407 wherein the lighter portion is heated by heat exchange against recovered deasphalting solvent as hereinafter described. The heated mixture in line 408 is introduced into an intermediate section of a combined tower, generally designated as 411, which combined tower 411 was previously the crude distallation tower of a crude unit, which has been modified so as to accomplish effective recovery of deasphalting solvent. As particularly shown, the combination tower 411 is divided into three sections: 412, 413, and 414, with each of the sections being designed to operate at different pressures. In particular, section 412 is operated at a pressure which is higher than the pressure in section 413. The pressure in the combination tower 411 does not exceed the design pressure for the tower; i.e. no greater than 100 psig.

The combination tower 411 is capable of being operated as a portion of a multiple effect evaporator for recovering deasphalting solvent.

The multiple effect evaporator is comprised of a low pressure section 413, and medium pressure section 412, both located in the combination tower 411, as well as a high pressure section, located in an extraneous vessel, as hereinafter described.

The low pressure section 413 is operated to provide for initial separation of deasphalting solvent from deasphalted oil. Deasphalting solvent, which is separated in section 413, is withdrawn therefrom through line 415. The low pressure section 413 is operated at a pressure in the order of 5 to 20 psig.

Deasphalted oil, containing some deasphalting solvent, is withdrawn from the low pressure section 413 of the combination tower 411 through line 416, and heated in heat exchanger 417 against recovered deasphalting solvent, as hereinafter described, prior to being introduced into medium pressure section 412. Section 412 is operated as the medium pressure section of a multiple effect-evaporator to recover additional deasphalting solvent. The pressure is generally from 35 to 45 psig. Deasphalting solvent which is flashed in section 412 is withdrawn therefrom through line 418.

Deasphalted oil, still containing some deasphalting solvent, is withdrawn from the medium pressure section 412 through line 421 and heated in heat exchanger 422 and fired heater 423 (which may be the crude heater of the prior crude unit), prior to being introduced into high pressure-vessel 424, which is the third stage of the multiple effect evaporation system for recovering deasphalting solvent from deasphalted oil. In generally, the high pressure flash vessel 424 is operated at a pressure of from 65 to 85 psig.

Deasphalting solvent is withdrawn from high pressure flash vessel 424 through line 425.

Deasphalted oil, still containing some deasphalting solvent, is withdrawn from the high pressure flash vessel 424 through line 426, and after depressurization, in introduced into a sidestream stripper, generally designated as 427, which was previously one or more of the sidestream strippers for the crude distillation unit. The sidestream stripper is provided with stripping gas, such as nitrogen, through line 428.

Deasphalted oil is withdrawn from sidestream stripper 427 through line 431 and is cooled against feed to vessel 424 in line 421 by passage through heat exchanger 422, prior to being passed to storage and/or further use through line 432.

Deasphalting solvent is recovered from the sidestream stripper 427 through line 433.

Referring back to the separator 404, the pitch fraction containing deasphalting solvent, in line 405, is heated against recovered pitch in heat exchanger 441, and is further heated in a fired heater 442, (which may be a fired heater from the previously existing crude unit), prior to being introduced into section 414 of the combination tower 411. The section 414 is provided with a stripping gas, such as nitrogen through line 443.

Section 414 is designed and operated to separate deasphalting solvent from pitch. The pitch is withdrawn from section 414 through line 445, and is cooled in exchanger 441 prior to being passed through line 446 for disposal or suitable use.

Deasphalting solvent which has been separated from pitch in section 414 is withdrawn therefrom through line 447.

Deasphalting solvent in line 447 is combined with deasphalting solvent in line 433, and the combined stream is suitably cooled (not shown) so as to condense the solvent for introduction into a solvent vessel 451 through line 452.

Flashed deasphalting solvent from the high pressure flash section 424 heats feed to the medium pressure flash section 412 in exchanger 417, and flashed solvent from the medium pressure section 412 heats feed to the low pressure flash section 413 in exchanger 407, and the flashed solvent from sections 412 and 424 may be further cooled (not shown) to effect condensation thereof.

Flashed solvent from low pressure section 413 in line 415 is also cooled (not shown) to condense the flashed solvent. The condensed flashed solvent from sections 412, 413 and 424 are combined in line 453 for introduction into the solvent storage vessel 451.

Deasphalting solvent is withdrawn from storage vessel 451 through line 402 for use in deasphalting, as hereinabove described.

Any uncondensed solvent, as well as nitrogen gas is withdrawn from vessel 451 through line 454 for further treatment to recover nitrogen and provide additional condensed solvent in a manner similar to that described with respect to previous embodiments.

According to this embodiment, the second stage 412 is operated at a higher pressure and temperature than that in the first stage 413, and the third stage 424 is operated at a higher temperature and pressure than that in the second stage 412. Moreover, the vapor from the second stage is employed for preheating feed to the first stage, and vapor from the third stage is employed for preheating feed to the second stage.

The present invention is directed to solvent refining of a wide variety of residues (residual oils). As representative examples of such feeds, there may be mentioned feeds derived from petroleum sources such as crude oil, atmospheric or long residue, vacuum or short residue, pyrolysis tars, black oils, shale oil, tar sands oil, various bitumens, as well as coal sources. etc.

Although the procedure has been described with reference to solvent refining of residues to remove pitch-like impurities, in such solvent refining, it is possible to remove other impurities such as sulfur, nitrogen, metallic impurities, etc, in conjunction with the pitch-like impurities. The degree of removal of such other types of impurities is dependent upon conditions employed and the scope of the invention includes removal of such other impurities. Accordingly, the term "solvent refining" as used herein refers to removal of such pitch-like impurities as well as removal of other impurities.

In addition, the term "pitch" or "pitch-like" impurities when used herein generally refers to the removal of pitch (which includes both the resin and asphaltene impurities) as well as to the removal of only asphaltenes; e.g., solvent refining so as to separately recover deasphalted oil, resins and asphaltene pitch.

The solvent which is used in the process may be any one of a wide variety of solvents which are used for solvent refining of residue. The solvent which is preferably employed and which may be comprised of one, two or more components, is one which can be condensed at pressures no greater than those employed in the combination tower; i.e., a pressure no greater than the design pressure of the pre-existing equipment. The solvent is preferably one that is available in the plant in which the solvent refining is employed. As representative examples of materials which may be employed in formulating a solvent for use in the process, these may be mentioned: methanol, ethanol, isopropanol, n-butanol, toluene, benzene, naphthas, gasolines, heptane, octane, ethers, ketones, kerosene, gas oils, etc. The solvent is preferably formed from one or more components which are condensable at a pressure no greater than the design pressure prevailing in the combination tower.

A particularly preferred solvent for use in the process is a solvent contains methanol and a propanol (i-propanol and/or n-propanol, preferably i-propanol). In a particularly preferred embodiment, the solvent is composed essentially only of methanol and a propanol, in particular methanol and isopropanol. Although the use of such a solvent has been particularly described with respect to the embodiment of FIG. 4 of the drawings, the use of such a solvent is not limited to such an embodiment. Thus, for example, the combination tower need not be designed and operated so as to achieve multiple effect evaporation. The use of a combination of isopropanol and methanol as a refining solvent produces a refined oil of high quality at high yields. In addition, a pumpable stream of pitch is obtained.

Although the present invention has been particularly described with reference to use of equipment in a pre-existing crude distillation unit, the scope of the invention is not limited thereby. Thus, for example, the process may be accomplished with new equipment or by using only a portion of the pre-existing equipment. Similarly, in a refinery or similar plants, there may be other low pressure equipment and in particular fractionators which can be converted for use in solvent refining of residues. Accordingly, although it is preferred to use idle equipment in a pre-existing crude distillation unit, the scope of the invention is not limited thereby.

The present invention will be further described with respect to the following examples: however, the scope of the invention is not to be limited thereby:

EXAMPLE I

The following are representative conditions for deasphalting in accordance with the embodiment of FIG. 2.

Feed: atmospheric residue
Solvent: 70 wt. % toluene and 30 wt. % methanol
Solvent/Feed Ratio: 3:1 (by wt.)

| Equipment | Temperature (°F.) | Pressure (Psia) |
|---|---|---|
| Separator 17 | 125° | 95 |
| Drum 21 | 265° | 50 |
| Combination Tower 29 | | |
| Section 28 | 350° | 40 |
| Section 31 | 500° | 40 |
| Separator 65 | 225° | 30 |
| Separator 73 | 125° | 25 |

Deasphalted Oil Yield: 70–75 volume %.

EXAMPLE II

The following are representative conditions for deasphalting in accordance with the embodiment of FIG. 4:
Feed: Vacuum residue
Solvent: 80 wt. % isopropanol, 20 wt. % methanol
Solvent/Feed Ratio: 2.5:1 (by wt.)

| Equipment | Temperature (°F.) | Pressure (Psia) |
|---|---|---|
| Separator 204 | | |
| Section 205 | 240° | 165 |
| Section 206 | 280° | 140 |
| Combination Tower 223 | | |
| Section 224 | 350° | 65 |
| Section 225 | 240–250° | 40 |
| Section 226 | 500° | 40 |
| Separator 254 | 200° | 30 |
| Separator 259 | 125° | 25 |

Deasphalted Oil Yield: 50–60 vol. %.

The hereinabove described solvent refining procedure may be employed in combination with other processing schemes so as to produce a desired final product.

Thus, for example, the feed to the solvent refining may be a vacuum residue, and the solvent refining unit is employed to provide a refined oil to supplement the feed to a fluid cat cracker. In such a scheme, the deasphalted oil must be of a hig quality, whereby there will be a low yield of deasphalted oil, and a high asphalt or pitch yield, which will be relatively light. The light pitch which is recovered from the combination tower may be employed as a fuel oil, as an asphalt product, or as a feed to a partial oxidation unit. Deasphalted oil may be employed in the fluid cat cracker unit in combination with a feed such as a gas oil to provide cat cycle oils. The cat cycle oil may be combined with the pitch recovered in the solvent refining unit to provide a fuel oil.

In another scheme, the solvent refining unit may be employed to clean an atmospheric residue feed to a residue cat cracker. In such an operation, fairly high yields of refined oil can be recovered. As a result, the asphalt yield will be low and may be primarily used as a solid pitch fuel.

In a further scheme, a vacuum residue may be treated by the solvent refining process, as hereinabove described, with deasphalted oil being employed as a feed to a hydrocracker. This would be similar to the scheme in which a vacuum residue is treated as a feed for a fluid cat cracker, as hereinabove described.

As still another scheme, a vacuum residue may be treated by the solvent refining process, and deasphalted oil is employed as a feed to a visbraking operation. This would be similar to the operation in which deasphalted oil is employed as a feed to a cat cracker, as hereinabove described.

As still another alternative, deasphalted oil from the solvent refining process as hereinabove described may be initially subjected to hydrodesulfurization or to hydrotreating so as to reduce the amount of metals, residual carbon, nitrogen and sulfur compounds contained in the oil, whereby a higher yield of deasphalted oil may be produced as feed to a fluid cat cracker or hydrocracker. In this embodiment, the asphalt or pitch quantity recovered from the solvent refining unit will be lower, and will be most suitable for use as a solid pitch fuel.

As still a further embodiment, the pitch recovered from the solvent recovery unit can be subjected to delayed coking, thus reducing the amount of solid fuel, and producing gas oil which can be employed as fuel.

These and other uses should be apparent to those skilled in the art from the teachings herein.

The present invention is particularly advantageous in that solvent refining of residues can be accomplished in equipment which exists in idle units, such as crude distillation units, without exceeding the design pressure for such units. Such a result can be economically achieved while effectively removing impurities.

These and other advantages should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. A process for solvent refining of a residual oil, comprising:

contacting a residual oil in a solvent refining zone with a refining solvent; recovering from the solvent refining zone a first mixture comprising solvent refined oil and refining solvent, and a second mixture comprising refining solvent and impurities separated from the residue, said impurities comprising pitch; introducing the first mixture into a first zone of a combination tower to separate refining solvent from solvent refined oil; introducing the second mixture into a second zone of the combination tower to separate refining solvent from impurities, said combination tower being operated at a pressure of no greater than 100 PSIG; recovering solvent refined oil having a reduced quantity of refining solvent from the combination tower; recovering impurities having a reduced quantity of refining solvent from the combination tower; and recovering refining solvent from the combination tower for recycle to the solvent refining zone.

2. The process of claim 1 wherein solvent recovered from the combination tower as vapor is condensed at a pressure of no greater than 100 PSIG for use in the solvent refining zone.

3. The process of claim 2 wherein the refining solvent is comprised of a precipitating component and a diluent component.

4. The process of claim 2 wherein refining solvent recovered in the second zone of the combination tower is introduced into the first zone of the combination tower for recovery with refining solvent separated in the first zone.

5. The process of claim 4 wherein a portion of the refining solvent recovered in the first zone of the combination tower is cooled and employed as liquid reflux in the first zone.

6. The process of claim 2 wherein the first zone of the combination tower includes at least two multiple effect evaporation sections for recovering refining solvent.

7. The process of claim 2 wherein the second zone of the combination tower is provided with a stripping gas for stripping refining solvent from the impurities.

8. The process of claim 2 wherein the refining solvent consists essentially of methanol and isopropanol.

9. The process of claim 8 wherein refining solvent separated from the solvent refined oil and impurities as a vapor is condensed at a pressure of no greater than 100 PSIG for recycle to the solvent refining zone.

10. The process of claim 9 wherein said refining solvent and residual oil are introduced into a crude unit desalter to separate impurities from a solvent refined oil.

11. The process of claim 10 wherein the first and second mixtures are heated prior to introduction into the crude distillation tower, at least a portion of said heating of at least one of the first and second mixtures being effected in a crude heater.

12. The process of claim 9 wherein the refining solvent consists essentially of methanol and isopropanol.

13. The process of claim 9 wherein a stripping gas is introduced into the second separating zone of the crude distillation tower to strip refining solvent from the impurities.

14. The process of claim 13 wherein the second separating zone is operated at a process lower than the first separating zone.

15. The process of claim 9 wherein the refining solvent is comprised of a precipitating component and a diluent component.

16. The process of claim 1 wherein the first mixture is introduced into a first flash section which is in the first zone to flash a first solvent portion and provide a first remaining mixture of solvent refined oil and refining solvent; introducing first remaining mixture into a second section which is in the first zone and operated at a pressure and temperature higher than the pressure and temperature in said first section to flash a second solvent portion and provide a second remaining mixture of solvent refined oil and refining solvent; employing second solvent portion to heat the first mixture prior to introduction into the first section; introducing second remaining mixture into a third section operated at a temperature and pressure higher than the pressure and temperature of the second section to flash a third solvent portion and provide solvent refined oil having a reduced quantity of refining solvent; employing third solvent portion to heat the first remaining mixture prior to introduction into the second section; and recovering first, second and third solvent portions as refining solvent for recycle to the solvent refining zone.

17. The process of claim 15 wherein first, second and third solvent portions are recovered and condensed at a pressure of no greater than 100 psig for use in the solvent refining zone.

18. The process of claim 16 wherein the refining solvent consists essentially of methanol and isopropanol.

19. The process for solvent refining of a residual oil, comprising:

contacting a residual oil in a solvent refining zone with a refining solvent at a pressure of from 50 to 250 psig; recovering from the solvent refining zone a first mixture comprising solvent refined oil and refining solvent, and a second mixture comprising refining solvent and impurities separated from the residual oil; introducing first and second mixtures into a crude distillation tower having first and second separation zone separate and distinct from each other, the first mixture being introduced into the first separation zone of the crude distillation tower to separate refining solvent from solvent refined oil, the second mixture being introduced into the second separation zone of the crude distillation tower to separate refining solvent from impurities, said impurities comprising pitch, said crude distillation tower being operated at a pressure no greater than 100 psig; recovering solvent refined oil having a reduced quantity of refining solvent from the crude distillation tower; recovering impurities having a reduced quantity of refining solvent from the crude distillation tower; and recovering refining solvent from the crude distillation tower for recycle to the solvent refining zone.

* * * * *